US008220285B2

(12) United States Patent
Park

(10) Patent No.: US 8,220,285 B2
(45) Date of Patent: Jul. 17, 2012

(54) REFRIGERATOR

(75) Inventor: Jin Woo Park, Changwon (KR)

(73) Assignee: LG Electronics Inc., Seoul (KR)

( * ) Notice: Subject to any disclaimer, the term of this patent is extended or adjusted under 35 U.S.C. 154(b) by 655 days.

(21) Appl. No.: 12/442,682

(22) PCT Filed: Oct. 23, 2007

(86) PCT No.: PCT/KR2007/005213

§ 371 (c)(1),
(2), (4) Date: Apr. 10, 2009

(87) PCT Pub. No.: WO2008/051000

PCT Pub. Date: May 2, 2008

(65) Prior Publication Data

US 2010/0024463 A1 Feb. 4, 2010

(30) Foreign Application Priority Data

Oct. 24, 2006 (KR) ..... 10-2006-0103566
Oct. 30, 2006 (KR) ..... 10-2006-0105819

(51) Int. Cl.
*F25C 1/22* (2006.01)

(52) U.S. Cl. ..... 62/340; 62/407

(58) Field of Classification Search ..... 62/340, 62/515, 407, 418, 419; 312/122, 402
See application file for complete search history.

(56) References Cited

U.S. PATENT DOCUMENTS

2002/0121095 A1* 9/2002 Adamski et al. ..... 62/3.6
2005/0236947 A1* 10/2005 LeClear et al. ..... 312/404
2006/0049731 A1* 3/2006 Choi et al. ..... 312/330.1
2007/0151281 A1* 7/2007 Jackovin ..... 62/344

FOREIGN PATENT DOCUMENTS

JP 6-257935 A 9/1994
JP 2003035490 A * 2/2003
JP 2004-116944 A 4/2004
KR 20-1989-0003209 Y1 5/1991

OTHER PUBLICATIONS

Abstract of JP 2003035490 to Okamoto et al.*
Translation ofP 6-257935 to Yamamoto Akira.*
Translation of JP 2004-116944 to Fukui Hiroichi et al.*
Translation of JP 2003-35490 to Okamoto et al.*

* cited by examiner

*Primary Examiner* — Mohammad Ali
(74) *Attorney, Agent, or Firm* — Birch, Stewart, Kolasch & Birch, LLP

(57) ABSTRACT

By means of a storage box structure according to the preferred embodiment of the present invention, the process installing the storage box into the storage space is easily accomplished and productivity of the product is obtained, and the inside of the storage box is partitioned, and therefore there is an advantage in that the usage of the storage space is increased.

16 Claims, 4 Drawing Sheets

[Fig. 1]
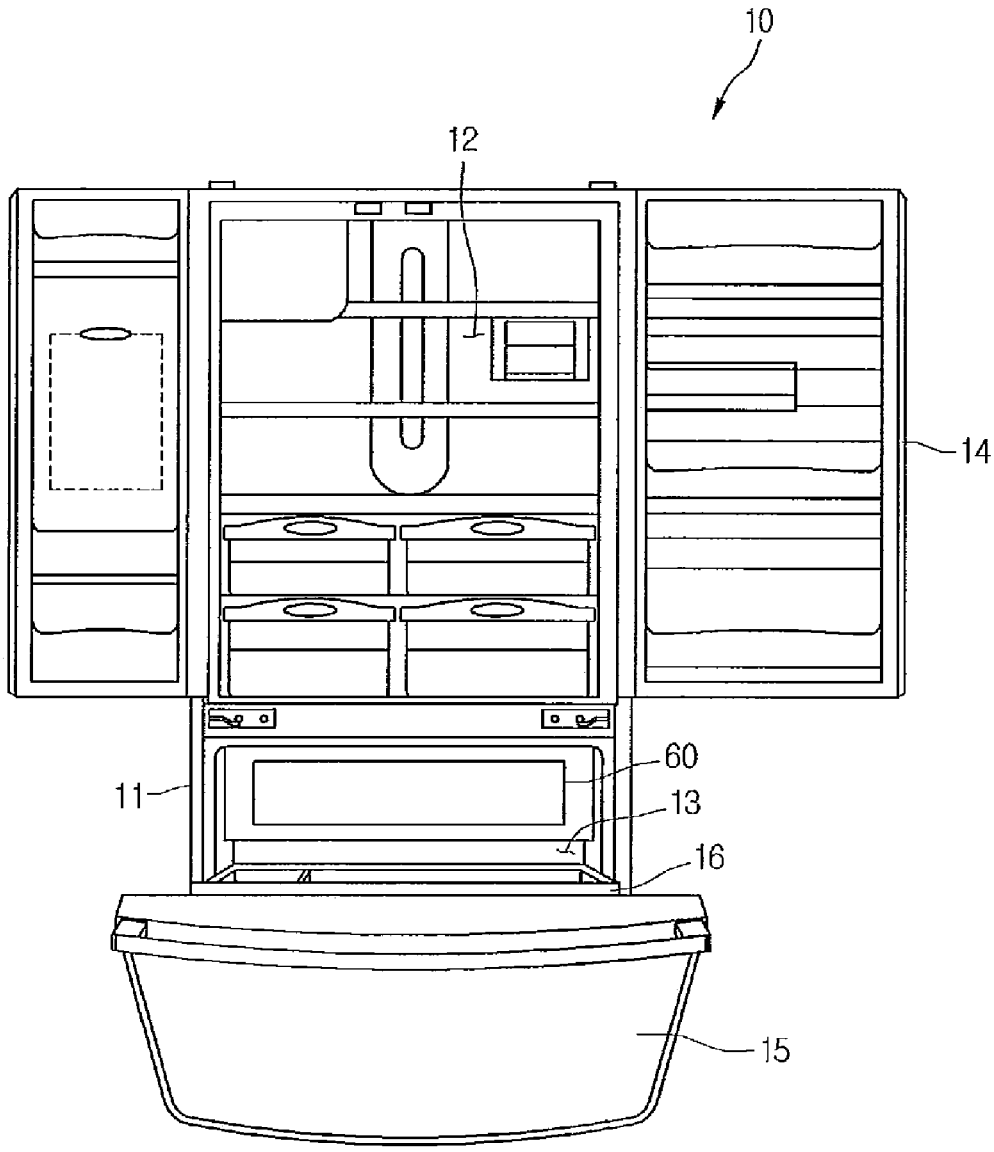

[Fig. 2]
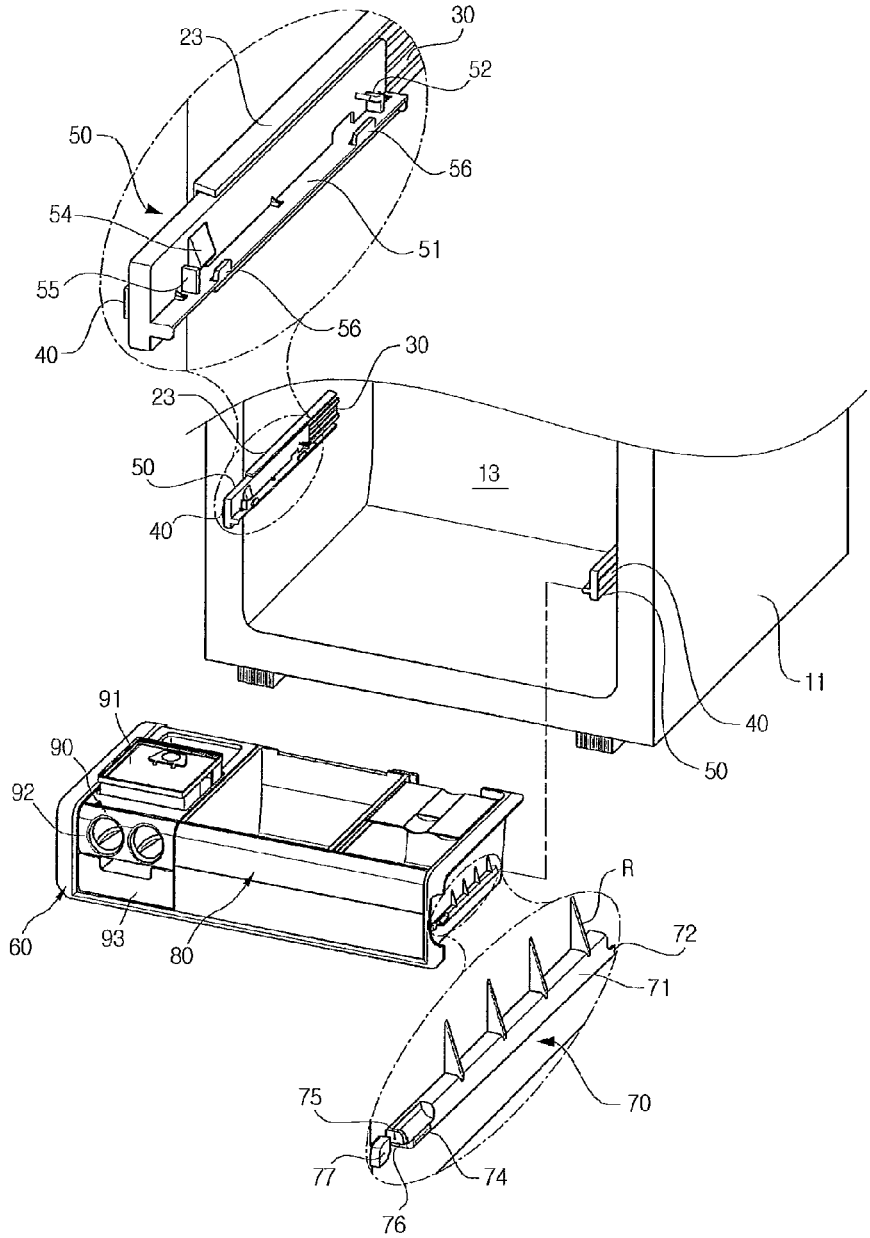
[Fig. 3]
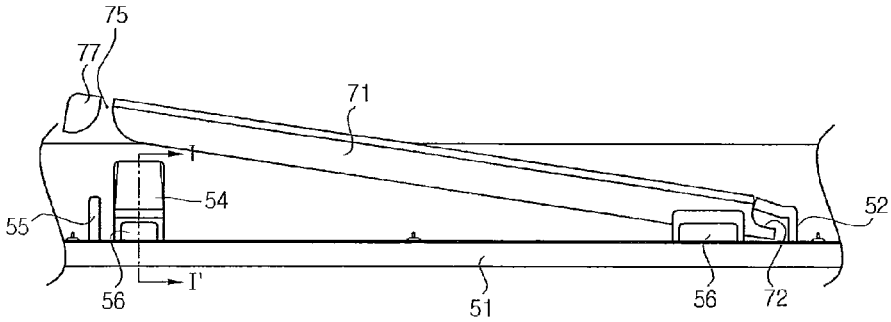

[Fig. 4]
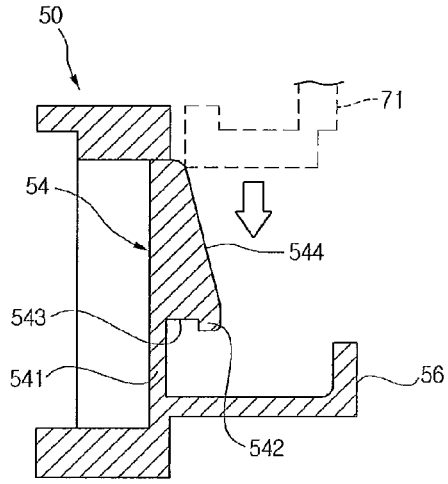
[Fig. 5]
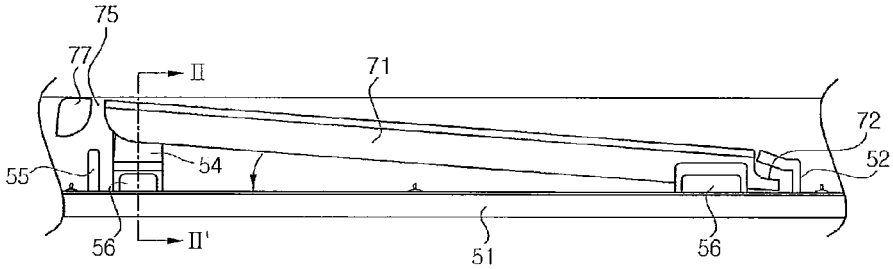
[Fig. 6]
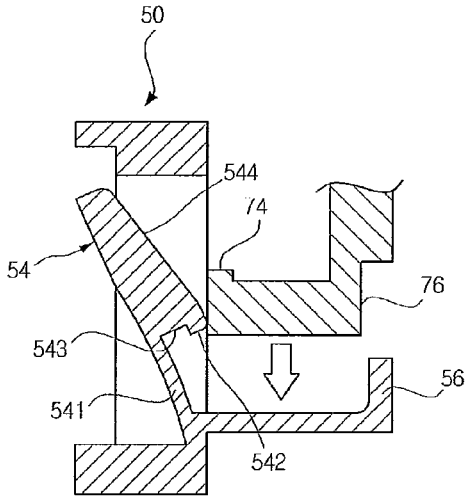
[Fig. 7]
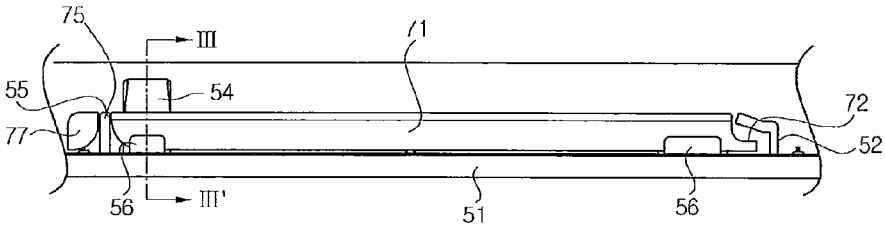

[Fig. 8]
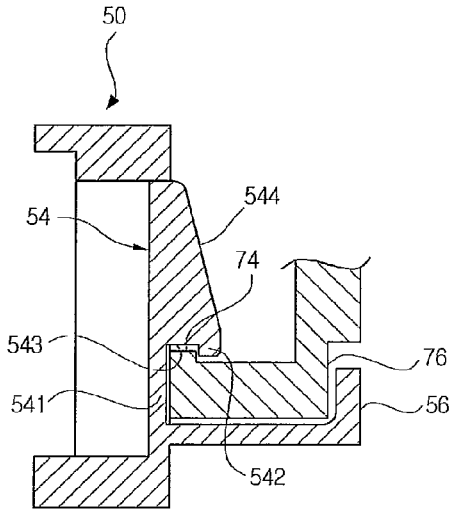
[Fig. 9]
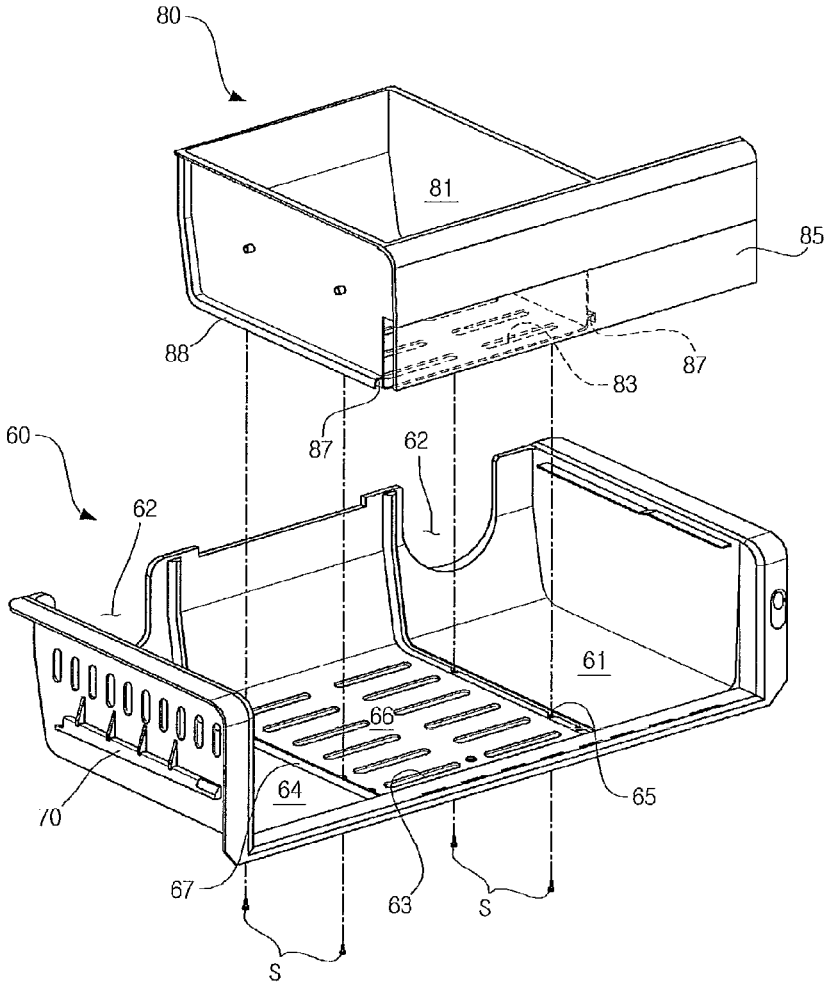

REFRIGERATOR

TECHNICAL FIELD

This document relates to a refrigerator.

BACKGROUND ART

Generally, refrigerators are home appliances for refrigerating or freezing foods to freshly store them for a long time, in which refrigeration cycle is operated by electric components provided therein and a storage space inside of the refrigerators is cooled by directly/indirectly using cold air generated from the refrigeration cycle.

Also, the refrigerators are classified depending on the position of a refrigerating chamber and a freezing chamber. That is, the refrigerators are classified into a top mount-type refrigerator in which a freezing chamber is disposed above a refrigerating chamber, a bottom-freezer type refrigerator in which a freezing chamber is disposed below a refrigerating chamber, and a side-by-side-type refrigerator in which a freezing chamber and a refrigerating chamber are horizontally arranged side-by-side.

Recently, there is an increasing demand for a bottom-freezer type refrigerator as the customers seek convenience. That is, there is an increasing demand for a bottom-freezer type refrigerator which can reduce the problem that a user have to bend down when taking in/out the food, since the refrigerating chamber, which is frequently used, is disposed above the freezing chamber.

Meanwhile, in the above-described bottom-freezer type refrigerator, it is more easy to take out the food because a storage box of the freezing chamber, which is disposed at the lower side, is configured as a drawer. And, a freezing chamber drawer in which frozen foods are stored, an ice-making device which is provided above the freezing chamber drawer, and a separate storage box are provided in the freezing chamber. And, the freezing chamber drawer and the storage box are slid along a rail element provided at the side of the freezing chamber in the back-and-forth direction. That is, the rail element is configured that a plurality of rails are able to be drawn in a multistage manner, one of the plurality of rails is fixed to the side of the refrigerator and the other is fixed to the side of the freezing chamber drawer or the storage box.

DISCLOSURE OF INVENTION

Technical Problem

According to the conventional refrigerator, one of the plurality of the rails is inserted into a rail fixed to the side of the refrigerator, in the state that the rail of the plurality of the rails is fixed to the side of the storage box. Therefore, there is a disadvantage that the process which install the storage box into the freezing chamber is complex and onerous.

Also, in case of the storage box disposed above the freezing chamber drawer, there is a disadvantage that different kinds of foods cannot be divided because the storage space is not partitioned into a plurality of sections.

The present invention is derived to resolve these problems, and an object of the present invention is to provide a storage box installation structure for a refrigerator, which can facilitate the installation of the storage box taken in/out of the storage space.

Also, another objection of the present invention is to provide a storage box assembly for a refrigerator, which can increase the usage of the storage space by partitioning the storage space inside the storage box.

Technical Solution

According to the present invention for achieving the objects, there is provided a refrigerator, including: a main body in which storage space is provided; an evaporator provided in the main body to generate cold air; a storage container drawably installed in the storage space in a back-and-forth direction; a pair of rail housings fixed to both sides of the storage space; a pair of rail elements connected to the pair of rail housings, respectively; a pair of connection elements pushed in and pulled out as a single body with the rail elements; and a pair of junctions provided at both sides of the storage box and connected to the connection elements.

In another aspect of the present invention, there is provided a refrigerator including: a main body in which storage space is provided; a storage container drawably installed in the storage space toward the inside and outside of the storage space; rail elements provided in both sides of the storage space and capable of being drawn in a multistage manner; and connection elements respectively fixed to the rail element to support the storage container, wherein the storage container is detachably connected to the connection elements.

In further another aspect of the present invention, there is provided a refrigerator including: a main body in which storage space is provided; a door selectively closing the storage space; an evaporator provided in the main body to generate cold air; a storage container drawably installed in the storage space; and a partition container interposed in the storage space to partition the storage space into a multitude of sections.

In further another aspect of the present invention, there is provided a refrigerator including: a main body; a storage container drawably installed in the storage space to the back-and-forth direction in a slide manner; a partition container partitioning the storage container into a multitude of sections; and connection elements movably mounted on inner side surface of the main body and detachably connected to the side surface of the storage container, wherein the storage container is connected to the connection element by an action pressing the connection element from the upside to the downside.

Advantageous Effects

In the refrigerator according to the preferred embodiments of the present invention, it is possible to easily secure the storage box to the connection element and it is also possible to easily separate the storage box from the connection element for the purpose of washing and replacing it. Therefore, convenience of the product is increased.

Also, according to the present invention, the working time required to secure/separate the storage box is decreased. Therefore, productivity of the product is increased.

Also, according to the present invention, the storage space of the storage box is divided into a plurality of regions by a partition box. Therefore, efficiency of the space is increased, since different kinds of foods may be separately received in the storage space.

Also, according to the present invention, a viewing window is provided in a front surface of the partition box to see the foods stored in the storage space. Therefore, the user may more conveniently use the product, since it is possible to see the foods stored in the storage space from the outside.

BRIEF DESCRIPTION OF THE DRAWINGS

FIG. 1 is a perspective view of a refrigerator having a storage box structure according to the preferred embodiment of the present invention.

FIG. 2 is an exploded perspective view showing a mount structure of a storage box for a refrigerator according to the preferred embodiment of the present invention.

FIG. 3 is a side view showing a state that a storage box begins to be connected to a connection element provided in a side of the storage space according to the preferred embodiment of the present invention.

FIG. 4 is a cross-sectional view taken along I-I' of FIG. 3.

FIG. 5 is a side view showing a state that another storage box is half connected to a connection element provided in a side of the storage space according to the preferred embodiment of the present invention.

FIG. 6 is a cross-sectional view taken along II-II' of FIG. 5.

FIG. 7 is a side view showing a state that a storage box is completely connected to a connection element provided in a side of the storage space according to the preferred embodiment of the present invention.

FIG. 8 is a cross-sectional view taken along III-III' of FIG. 7.

FIG. 9 is an exploded perspective view showing a construction of a storage box according to the preferred embodiment of the present invention.

MODE FOR THE INVENTION

Hereinafter, the present invention will be explained in detail with reference to the accompanying drawings. It will be apparent to those skilled in the art that various modifications and variations can be made without departing the broad scope and aspect of the present invention as defined in the appended claims.

Hereinafter, it is noted that the present invention will be explained as an example of the bottom-freezer type refrigerator, and the present invention is not limited thereto, but it can also be applied for various refrigerators.

FIG. 1 shows a refrigerator having a storage box structure according to the preferred embodiment of the present invention in a perspective view.

Referring to FIG. 1, the refrigerator 10 according to the preferred embodiment of the present invention includes a main body 11 in which a refrigerating chamber 12 and a freezing chamber are provided; a refrigerating chamber door 14 rotatably mounted on the front surface of the main body 11 to selectively close the refrigerating chamber 12; a freezing chamber door 15 selectively closing the freezing chamber 13 and movable in the back and forth direction, a freezing chamber drawer 16 connected to the r ear of the freezing chamber door 15, and a storage box 60 disposed above the freezing chamber drawer 16.

Particularly, a plurality of shelves on which the foods are seated and a plurality of storage boxes for receiving foods, which are required to be refrigerated, are provided in the refrigerating chamber 12. And, the freezing chamber drawer 16 and the storage box 60 are received in the freezing chamber 13 and mounted movably in the back-and-forth direction thereon. And, the freezing chamber drawer 16 and the storage box 60 are mounted movably in the back-and-forth direction by a rail structure.

Hereinafter, the rail structure which allows the in-and-out movement of the storage box 60, and the connection relation between the storage box and the rail structure will be explained in detail with reference to the accompanying drawings.

FIG. 2 shows a mount structure of a storage box for a refrigerator according to the preferred embodiment of the present invention in an exploded perspective view.

Referring to FIG. 2, a rail housing 23 is respectively provided in both sides of the storage space, such as the freezing chamber 13 formed in the refrigerator main body 11. The rail housing 23 is secured to the storage space, i.e. the inner side of the freezing chamber 13. And, a rail element which is able to be drawn in a multistage manner is connected to the rail housing 23.

Particularly, the rail element includes a fixing rail 30 secured to the rail housing 23, and a moving rail 40 slidably connected to the fixing rail 30. And, a connection element 50 connecting the storage box 60 is secured to the moving rail 4 by a fastening element such as a screw.

Also, a support rib 51 which extends with a predetermined width and length is formed at the side of the connection element 50. On the support rib 51, a junction 70 which will be described below is seated. And, a latch hook 52 is provided in the rear end of the support rib 51. The latch hook 52 is extended from the upper surface of the support rib 51 and upwardly bent toward the front surface of the connection element 50 at a predetermined angle.

And, a fixing hook 54 is provided in one side of the front end of the support rib 51. Particularly, the fixing hook 54 includes a vertical portion 541 which is upwardly extended from one side of a top of the support rib 51 in an elastically deformable manner in a horizontal direction; a slanted portion 544 provided in a tip of the vertical portion 541 and inclined in the direction that the width is narrowed as it goes to the top; a latch jaw 542 downwardly protruded from a bottom of the slanted portion 544; and a fastening groove 543 upwardly depressed from the bottom of the slanted portion 544 (referring to FIG. 4).

Also, a stopper 55 which is upwardly protruded is provided in the front end of the support rib 51. And, a separation prevention rib 56 upwardly protruded from the outer end of the top of the support rib 51 is provided in the front and rear of the support rib 51, respectively. Particularly, the separation prevention rib 56 prevents the junction 70 seated on the support rib 51, which will be described below, from being detached.

Meanwhile, the junction 70 which extends long in the back-and-forth direction is respectively provided in both sides of the storage box 60 which is to be accommodated in the freezing chamber. Particularly, the junction 70 includes a seating rib 71 seated on the top of the support rib 51, a latch 72 formed at the rear end of the seating rib 71 and to which the latch hook 52 is connected, a fastening projection 74 protruded at the lower portion of the front end of the seating rib 71, and a stopper projection 77 protruded at a position spaced apart from the front end of the seating rib 71.

More particularly, the latch 72 is connected with the latch hook 52 in a mirror-image fashion, as some of the rear end of the top of the seating rib 71 is downwardly inclined toward the lower part at a predetermined angle. The fastening projection 74 is inserted and fixed into the fastening groove 543 of the fixing hook 54 (referring to FIG. 8). And, a latch groove 73 is depressed and formed in the front end of the seating rib 71 at a predetermined depth, and a head portion of the fixing hook 54, i.e. a bottom of the slanted portion 544 is fastened thereto.

Also, the stopper 55 is inserted into an isolated space 75 formed between the front end of the seating rib 71 and the stopper projection 77. And, a seating groove 76 is formed in the bottom of the seating rib 71. The seating groove 76 is upwardly depressed and formed at a point where the seating rib 71 and the side of the storage box 60 meet. And, if the seating rib 71 is seated on the support rib 51, and then the separation prevention rib 56 is inserted into the seating groove 76.

And, a plurality of reinforcement pieces R, which are connected to the side of the storage box 60, are provided on the top of the seating rib 71. The reinforcement pieces R serve to reinforce the seating rib 71.

Meanwhile, an ice-making device 90 and a separate partition box 80 are seated on one side of the storage box 60. Particularly, the ice-making device 90 includes a water tank 91 in which water for making ice is stored, an ice-making tray 92 in which water supplied from the water tank 91 is collected to make ice in the shape of specific shapes, and an ice bin 93 in which ice cubes made from the ice-making tray 92 are stored. And, the partition box 80 is provided to increase the usage of the space by partitioning the inner space of the storage box 60, except the space where the ice-making device 90 is seated. This will be explained in detail with reference to the drawings.

FIG. 3 shows a state that a storage box begins to be connected to a connection element provided in a side of the storage space according to the preferred embodiment of the present invention in a side view. FIG. 4 shows the section I-I' of FIG. 3 in a cross-sectional view.

Referring to FIGS. 3 and 4, in order to connect the storage box 60 to the connection element 50, the connection element 50 is drawn toward the front of the freezing chamber 13 by pulling the moving rail 40 forward. After that, the storage box 60 is positioned on the top of the connection element 50. Here, the storage box 60 is positioned on the connection element 50 in a state that the storage box is downwardly inclined.

In other words, the rear end of the seating rib 71 provided on both sides of the storage box 60 is downwardly inclined and moved to the rear end of the support rib 51. And, as shown in FIG. 3, the latch 72 provided in the rear end of the seating rib 71 is inserted in the latch hook 52 of the support rib 51.

FIG. 5 shows a state that another storage box is half connected to a connection element provided in a side of the storage space according to the preferred embodiment of the present invention in a side view. FIG. 6 shows the section II-II' of FIG. 5 in a cross-sectional view.

Referring to FIGS. 5 and 6, if the front surface of the storage box 60 is lowered in a state of FIG. 4, the seating rib 71 of the junction 70 presses the fixing hook 54. And, the fixing hook 54 is bent toward the inside of the connection element 50 by the descent of the seating rib 71. Here, the head portion is bent by the descent of the seating rib 71 as shown in FIG. 6, since the head portion is a slanted portion 544 of which the width is increased toward the bottom. And, the vertical portion 541 of the fixing hook 54 has a predetermined elastic force, and therefore it returns to initial position when the seating rib 71 is seated on the support rib 51. This will be explained in detail with reference to FIGS. 7 and 8.

FIG. 7 shows a state that a storage box is completely connected to a connection element provided in a side of the storage space according to the preferred embodiment of the present invention in a side view. FIG. 8 shows the section III-III' of FIG. 7 in a cross-sectional view.

Referring to FIGS. 7 and 8, the front end of the seating rib 71 is completely seated on the support rib 51 as the storage box 60 is further lowered. After that, the fastening projection 74 of the junction 70 is inserted into the fastening groove 543 of the fixing hook 54. And, the bottom of the head portion of the fixing hook 54 is fastened with the latch groove 73 depressed in the front end of the junction 70. And, the separation prevention rib formed in the connection element 50 is inserted into the seating groove 76.

After the assembly process is completed, the front and rear ends of the seating rib 71 are tightly connected to the stopper 55 and latch hook 52 of the connection element 50. Therefore, the storage box 60 is prevented from being trembled from the connection element 50 in a back-and-forth direction.

Also, the storage box 60 is prevented from being trembled from the connection element 50 in the side-by-side direction by the separation prevention rib 56. That is, the storage box 60 is integrally assembled with the connection element 50, and thus, the moving rail 40 connected to the back of the connection element 50 is drawn from the fixing rail 30 when the storage box 60 is drawn.

Meanwhile, the process detaching the storage box 60 from the connection element 50 is progressed in reverse order. That is, the front end of the storage box 60 is raised by pushing the latch jaw 542 of the fixing hook 54 provided in the support rib 51 toward the inside of the connection element 50. And, the fastening projection 74 is detached from the fixing hook 54, and the stopper 55 and the separation prevention rib 56 are spaced apart from the isolated space 75 and the latch groove 76, respectively. And, the latch state is released because the latch 72 is get out of the latch hook 52. The storage box 60 is separated from the connection element 50 by this separation action.

FIG. 9 shows a construction of a storage box according to the preferred embodiment of the present invention in an exploded perspective view.

The explanation of the construction of the storage box without the ice-making device 90 is described with reference to FIG. 9.

Referring to FIG. 9, the storage box 60 according to the preferred embodiment of the present invention is formed as a hexahedron shape, of which the top and the front surface are opened. And, the storage box 60 is mounted on the top of the freezing chamber 13, and the storage box 60 is mounted so that the bottom of the storage box 60 is spaced apart from the top of the freezing chamber drawer 16 at a predetermined distance.

Also, the partition box 80 having a separate storage space is seated in the storage box 60. And, the inside of the storage box 60 is divided into an ice-making space 64 in which the ice-making device 90 is seated, a partition box space 66 in which the partition box 80 is seated, and a rest space 61. A plurality of cold air feeding slits 63 are provided in the bottom center of the storage box 60, i.e. the bottom of the partition box space 66. The cold air circulating the storage space such as the freezing chamber 13 is supplied into the storage box through the cold air feeding slits 63.

Also, a cold air feed hole 62 to which cold air passed through the evaporator (not shown) is depressed and formed at the rear of the storage box 60 at a predetermined depth. Of course, a cold air feed hole is also formed at the rear wall of the freezing chamber corresponding to the position of the cold air feed hole 62. And, the cold air feed hole 62 may be formed at the rear wall where the ice-making device 90 is not mounted and at the rear wall of the storage box 60 that is not covered by the partition box 80, respectively.

Also, at least one fastening hole 25 is formed in the bottom of the storage box 60. A fastening screw S passed through the fastening hole 25 passes through the bottom of the partition box 80. That is, the partition box 80 is secured to the bottom of the storage box 60 by the fastening screw S.

Also, a box support rib 67 is formed along the bottom and the rear of the storage box 60. Particularly, the box support rib 67 is protruded from the bottom and the rear of the storage box 60 at a predetermined height. And, the box support rib 67 serves to set a seating position of the partition box 80. In other words, a pair of box support ribs 67 may be formed as they are spaced apart at a distance corresponding to the width of the partition box 80.

Meanwhile, the partition box 80 partitioning the storage box 60 into a plurality of storage spaces is formed as a hexahedron shape, and is provided with storage space 81 to store foods. In the bottom of the partition box 80, a plurality of cold air feeding slits 83 connected with the cold air feeding slits 63 of the storage box 60 are provided. The cold air feeding slits 83 of the partition box 80 are to provide cold air to the foods stored in the storage space 81 of the partition box 80.

The front surface of the partition box 80 is further extended from the edge to the side (light side of the drawing), and it is tightly connected to the tip of the side of the storage box 60. That is, the partition box 80 itself is a part of the storage box 60, however the front surface of the partition box 80 completely closes the front surface of the storage box 60, except the front of the ice-making space 64.

And, a viewing window 85 is provided in at least some of the front surface of the partition box 80. Particularly, the viewing window 85 is made of a transparent or translucent material. And, the user may see the foods stored in the storage space 61 of the storage box 60 and the storage space 81 of the partition box 80 through the viewing window 85 from the outside.

Meanwhile, a position setting rib 88 is formed along the lower end of both sides and the periphery of the rear end in the storage box 60. And, the position setting rib 88 is bent in the shape of a "□" and forms a fixing groove 87 at the inside. And, the box support rib 67 is inserted into the fixing groove 87. That is, the seating position of the partition box 80 is determined by the connection of the position setting rib 88 and the box support rib 67.

Hereinafter, the action of the storage box for a refrigerator according to the present invention will be explained in detail.

First, the assembly process of the storage box for a refrigerator according to the present invention is explained.

The partition box 80 is moved in the storage space 21 of the storage box 60 so that the box support rib 67 provided in the bottom of the storage box 60 is inserted into the fixing groove 87 formed in the inner side of the position setting rib 88. Here, the cold air feeding slit 63 of the storage box 60 has to be connected to the cold air feeding slit 83 of the partition box 80.

Also, the extended portion of the front surface in the partition box 80 is tightly connected to the tip of the right side in the storage box 60. At the same time, the relative position of the storage box 60 and the partition box 80 is determined, as the box support rib 67 is inserted into the fixing groove 87.

In this state, the partition box is secured to the bottom of the storage box 60 by the fastening screw S. Here, a fastening boss of a predetermined length may be protruded from the bottom of the partition box 80 where the fastening screw S is passed through. And then, the bottom of the partition box 80 is slightly spaced apart from the bottom of the storage box 60 by the fastening boss, and therefore it is possible to abundantly feed cold air through the cold air feeding slits 63, 83.

Next, the using process of the storage box for a refrigerator according to the preferred embodiment of present invention is explained.

First, the user pulls the storage box 60 toward the front of the freezing chamber 13. And then, the storage box 60 is drawn out of the freezing chamber 13, and therefore the user may take the foods in and out of the storage box 60 or the partition box 80. And, if the incoming and outgoing of the foods are completed, the storage box 60 is pushed into the freezing chamber.

Also, the user may see the foods stored in the storage box 60 and the partition box 80 through the viewing window 85 from the outside. Here, it is noted that the combination of the storage box 60 and the partition box 80 may be referred to as a storage box assembly.

The invention claimed is:

1. A refrigerator, comprising:

a main body in which storage space is provided;

a storage container drawably installed in the storage space in a back-and-forth direction;

a pair of rail housings fixed to both sides of the storage space;

a pair of rail elements connected to the pair of rail housings, respectively;

a pair of connection elements pushed in and pulled out as a single body with the rail elements; and a pair of junctions provided at both sides of the storage container and connected to the connection elements, wherein each of the connection elements includes:

a support rib in which the junctions are seated;

a latch hook protruded from a top surface of the support rib and fixing a rear end of the junctions; and a fixing hook extended from the top surface of the support rib with a predetermined elastic force and fixing a front end of the junctions, and wherein each of the junctions includes:

a seating rib extended at a side surface of the storage container in a back-and-forth direction and seated on the support rib; and a fastening projection formed in the seating rib and caught to the fixing hook.

2. The refrigerator according to claim 1, wherein a latch which is stepped at a predetermined depth to be caught to the latch hook is formed in the rear end of the seating rib, and a latch groove which is depressed at a predetermined depth to be caught to the fixing hook is formed in the front peripheral surface.

3. The refrigerator according to claim 1, wherein at least one separation prevention rib which is to prevent the seating rib from detaching is formed in the support rib, and a seating groove in which the separation prevention rib is inserted is formed the bottom surface of the seating rib.

4. The refrigerator according to claim 1, further comprising:

a stopper projection protruded at a position which is spaced apart from the front end of the seating rib; and a stopper upwardly protruded from the support rib and inserted into the space between the stopper projection and the front end of the seating rib.

5. The refrigerator according to claim 1, wherein the rail elements include a fixing rail fixed to the rail housings, and one or more moving rails extendably connected to the fixing rail, and wherein the connection elements are fixed to the moving rail which is extended to a forefront.

6. A refrigerator, comprising:

a main body in which storage space is provided;

a storage container drawably installed in the storage space toward the inside and outside of the storage space;

rail elements provided in both sides of the storage space and capable of being drawn in a multistage manner;

connection elements respectively fixed to the rail elements to support the storage container; and junctions connected with the connection elements and integrally formed in both sides of the storage container, respectively, wherein the storage container is detachably connected to the connection elements, and wherein each connection element includes:

a latch hook to which the rear end of the junction is connected;

a fixing hook to which the front end of the junction is connected, the fixing hook being returned to its initial position after being bent in the connection process of the junction;

a separation prevention rib which prevents the junction from detaching or trembling in a side-by-side direction; and a stopper which prevents the junction from detaching in a forward direction.

7. The refrigerator according to claim 6, wherein the latch hook is bent in the shape of a "]", and the rear end of the junction is inserted into the latch hook.

8. The refrigerator according to claim 6, wherein the fixing hook includes:

a vertical portion capable of being bent with a predetermined elastic force;

a slanted portion formed at the top of the vertical portion, the slanted portion getting narrower toward the top side thereof; and a fastening groove upwardly depressed at the rear end of the slanted portion, wherein a fastening projection is formed at the lower side of the junction and inserted into the fastening groove.

9. The refrigerator according to claim 6, wherein the connection element is fixed to at least the rail which is drawn out of the storage space.

10. A refrigerator, comprising:

a main body in which storage space is provided;

a door selectively closing the storage space;

a storage container drawably installed in the storage space; and a partition container interposed in the storage space to partition the storage space into a multitude of sections, wherein a pair of support ribs which are extended to set a position of the partition container are formed on an inner peripheral surface of the storage container, and wherein a position setting rib in which the support ribs are accommodated is extended at least on a side periphery of the partition container.

11. The refrigerator according to claim 10, wherein ice-making space is defined in one side of the storage container, the partition container partitions the storage space except the ice-making space.

12. The refrigerator according to claim 10, wherein a cold air feeding hole is formed in at least one bottom of the storage container and the partition container.

13. The refrigerator according to claim 10, wherein a storage space occupying a part of the storage container is formed in the partition container, and a front end of the partition container is extended to a side surface of the storage container.

14. The refrigerator according to claim 13, wherein a viewing window is formed on at least a portion of the partition container.

15. The refrigerator according to claim 10, wherein the partition container is mounted on a bottom surface of the storage container, in a state that the partition container is spaced apart from the bottom surface of the storage container.

16. The refrigerator according to claim 10, further comprising: junctions formed on side surfaces of the storage container; rail elements provided in both sides of the storage space and capable of being drawn in a multistage manner; and connection elements connecting the rail elements with the junctions.

* * * * *